US005351452A

United States Patent [19]

Gates

[11] Patent Number: 5,351,452

[45] Date of Patent: Oct. 4, 1994

[54] DRYWALLING METHOD AND APPARATUS

[75] Inventor: James R. Gates, Glendora, Calif.

[73] Assignee: Gateway Drywall Company, San Dimas, Calif.

[21] Appl. No.: 114,474

[22] Filed: Aug. 31, 1993

[51] Int. Cl.[5] ..... E04B 1/00

[52] U.S. Cl. ..... 52/254; 52/204.55; 52/344

[58] Field of Search ..... 52/344, 348, 349, 353, 52/359, 363, 287, 288, 254, 255, 204.53, 204.54, 208, 211, 212, 204.55

[56] References Cited

U.S. PATENT DOCUMENTS 3,238,679 3/1966 Capoccia ..... 52/254

*Primary Examiner*—Carl D. Friedman
*Assistant Examiner*—Creighton Smith
*Attorney, Agent, or Firm*—Price, Gess & Ubell

[57] ABSTRACT

A unitary molding or corner piece for drywalling applications includes a flange mounted at a right angle to a rectangular panel of a width selected to extend and position the flange so that the flange may receive the end of a wall panel and be nailed to a frame stud. In a second embodiment, a molding including a flange and panel surrounds the window and the window frame contains a conforming slot for receiving and holding the edge of the panel.

16 Claims, 2 Drawing Sheets

DRYWALLING METHOD AND APPARATUS

BACKGROUND OF THE INVENTION

1. Field of the Invention

The subject invention relates generally to the building and construction industry and, more particularly, to a method and apparatus for more efficiently and effectively installing drywall around windows.

2. Description of Related Art

The approach to installing drywall around window openings according to prior art is extremely cumbersome. Perhaps one-third of the time spent doing pick-up work on the interior of a dwelling is on window openings.

Typically, an elongated rectangular piece of drywall, known as a "return" or "reveal," is cut and nailed to a 2×4 stud frame member adjacent the window opening. The drywall wall panel is then aligned at a right angle with the return and nailed to the stud. The abutment of the wall panel and the return forms a linear rough outer edge, which is then covered with a piece of "cornerbead." The cornerbead must be cut to length and nailed into place. Material known as "mud" is then applied around the cornerbead to create a finished appearance.

Numerous problems exist with the prior art approach. The numerous steps involved are obviously labor intensive. Errors can be made at each step of the way. For example, sanding and texturing of the mud coats may scratch the window return and otherwise damage adjacent surfaces. The stud to which the return is nailed may be cocked-in causing the return to be misaligned. Typically, misalignment and other defects may not be discovered until the entire final assembly is inspected, requiring expensive and wasteful reconstruction of the drywall interface.

SUMMARY OF THE INVENTION

It is therefore an object of the invention to provide improved apparatus for use in installation of drywall.

It is another object of the invention to provide such apparatus which reduces the number of operations required to be performed in installing drywall in connection with window openings.

It is another object of the invention to eliminate problems associated with alignment of returns in prior art approaches.

It is another object to provide for drywall installation which avoids or reduces the risk of damage to attendant surfaces.

These and other objects are achieved according to the invention by providing a molding member mountable in the window opening generally adjacent the stud, but not attached thereto. The mounting member includes a planar flange attached at right angles to a planar panel. The panel mounts in the window opening so as to extend the flange outwardly to receive and overlap an interior wall panel. The flange is nailed to the stud, and the panel is preferably secured in position by appropriate means. In this manner, the molding member is gapped away from the stud such that distortion of the stud does not interfere with its mounting. The unitary nature of the apparatus according to the invention eliminates the need to cut and abut a separate return panel, cut and attach the cornerbead and thereafter perform two mudding operations.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
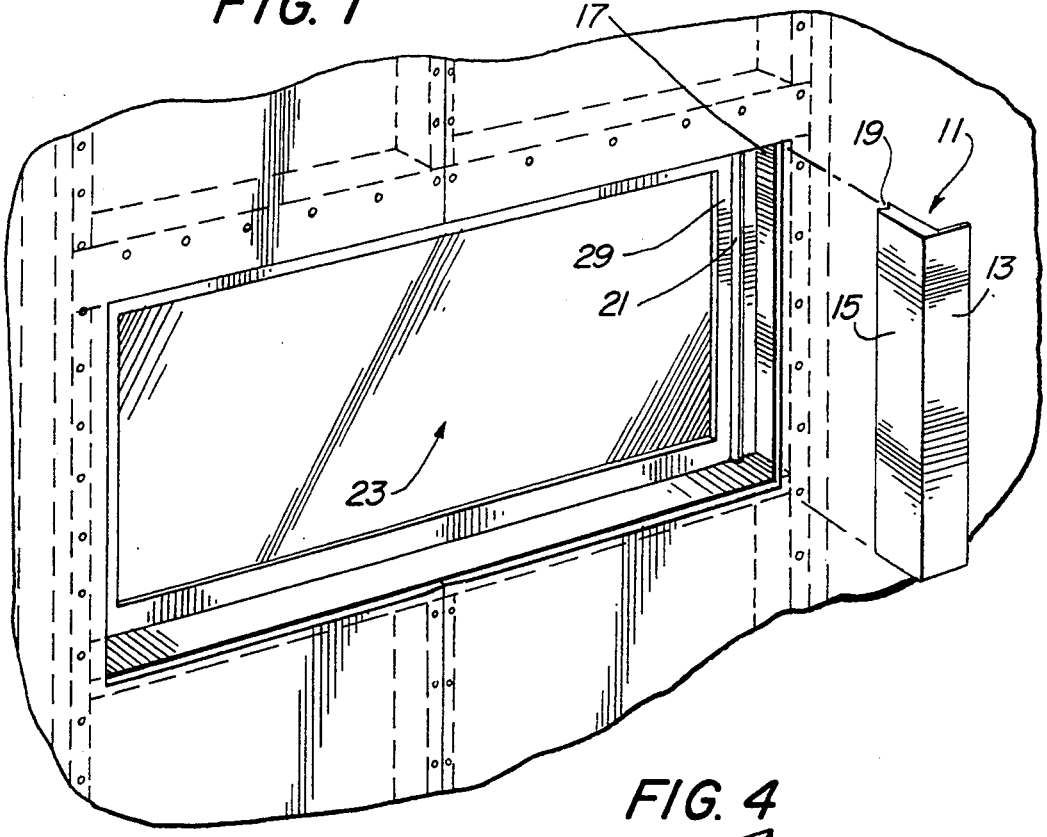
FIG. 1 is a perspective schematic illustrating a preferred embodiment of the invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide improved apparatus for use in installation of drywall.

According to the preferred embodiment, a unitary-molding member 11 is provided. The molding member 11 includes a generally rectangular panel 15 and a generally rectangular flange 13. The panel 15 and flange 11 make a 90° or right angle with one another. The flange 13 may be, for example, of 2" to 1/16" or less in thickness "$t_1$", 1/16" being typical while the panel has a thickness "$t_2$", typically comparable to the thickness of a drywall sheet. The molding 11 is preferably a unitary member formed, for example, by molding or extruding various plastics. The material is selected such that nails can be driven through the flange 13 to attach it to a stud 17 adjacent a window opening 23.

Figure 2:
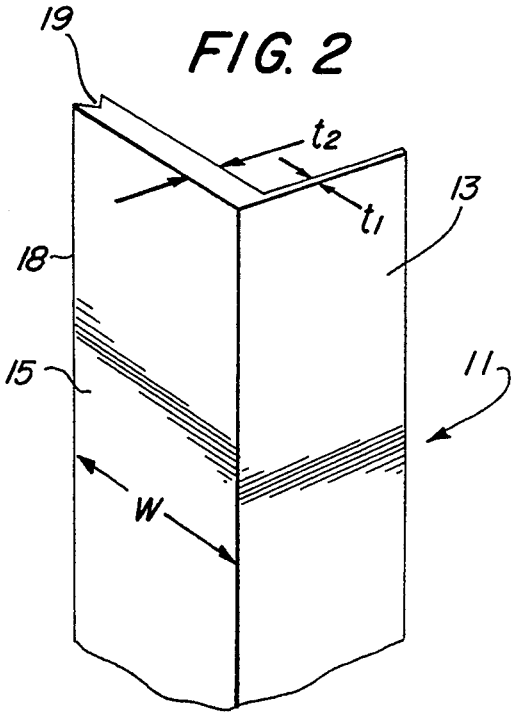
FIG. 2 is a perspective sectional view of a molding member according to the preferred embodiment.
Figure 4:
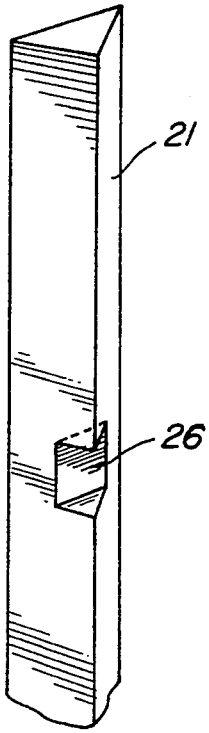
FIG. 4 is a perspective view of attachment apparatus useful in connection with implementation of the preferred embodiment.

In the embodiment shown in FIG. 1, a vertical tongue-and-groove arrangement is employed to stabilize the molding 11 against horizontal movement in the window opening 23. Thus, a groove 19 is provided in the vertical edge 18 of the molding 11. A matching tongue 21 is installed and aligned vertically in the window opening 23. As shown in FIG. 4, the tongue 21 may have cutouts 26 along its extension so as to provide a location at which to nail or otherwise attach the tongue 21 to the window frame 29. Thus, the molding 11 is held in place by the tongue-and-groove interaction and by nailing through flange 13 to the stud 17. Use of the tongue 21 provides for accurate vertical alignment of the molding 11, regardless of misalignment of the stud 17. Other means of attaching or horizontally stabilizing a molding 11 according to the preferred embodiment may be employed besides the tongue-and-groove method shown in connection with FIGS. 1–4. Accordingly, the end surface of the molding 11 may be flat rather than having a groove 19 therein as shown in FIG. 2.

Figure 3:
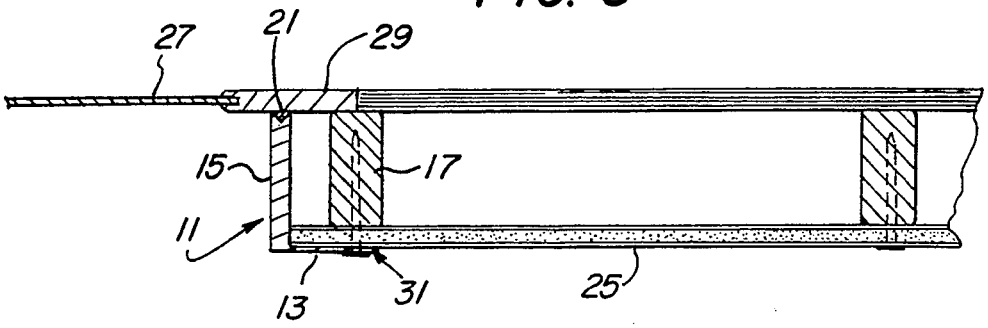
FIG. 3 is a top cross-sectional view illustrating positioning of the preferred embodiment in a typical application.

As illustrated in FIG. 3, the width "W" of the panel 15 is selected to position the flange 13 at a distance from stud 17 such that a drywall sheet 25 fits into the gap between the flange 13 and the stud 17. Silicone sealant may be inserted into the gap between the stud 17 and the panel 15 to provide further stabilization and insulation. With the molding 11 installed as shown in FIG. 3, it is then only necessary for the drywaller to tape and mud along the abutment of flange 13 with drywall 25 at edge 31.

Figure 5:
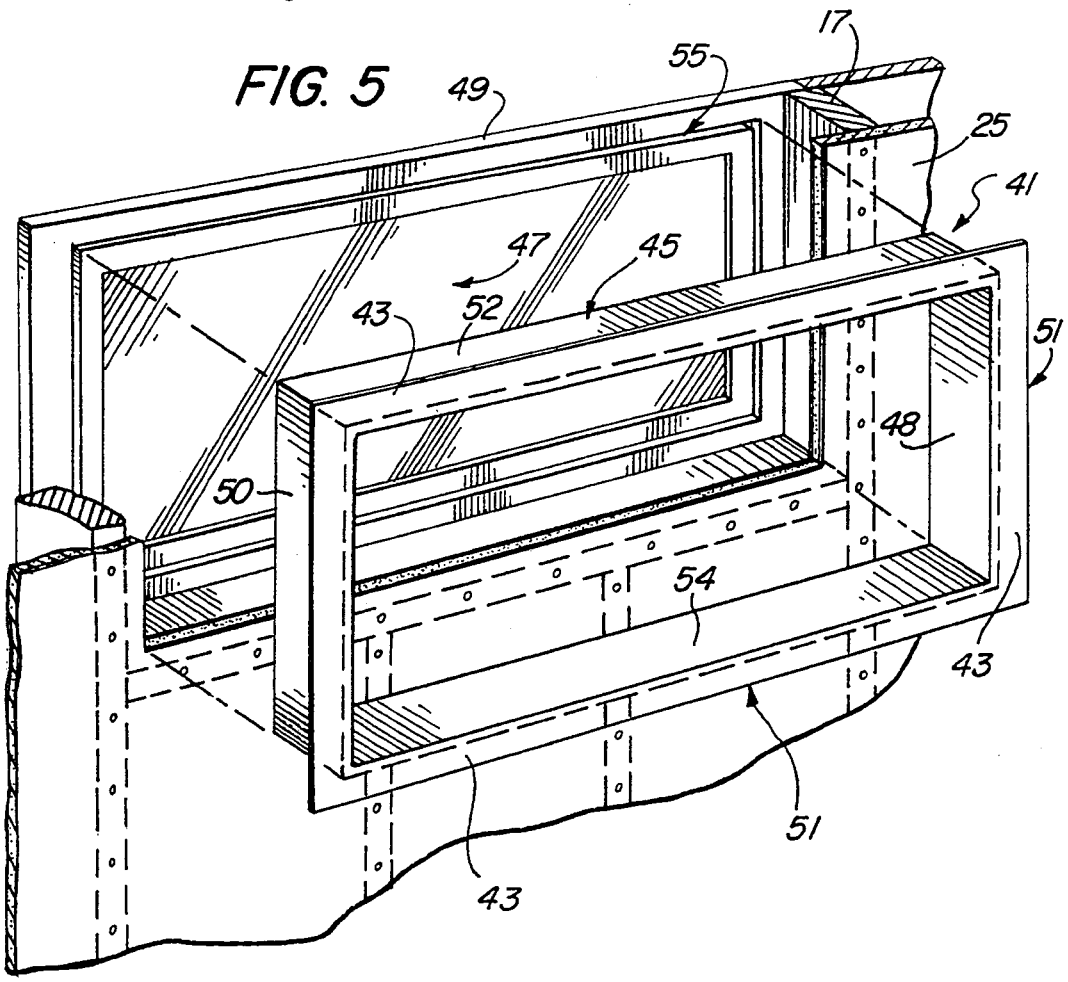
FIG. 5 is a perspective schematic view of a second embodiment according to the invention.

FIG. 5 illustrates a very advantageous embodiment according to the invention in which the window frame 49 and a molding 43 cooperate to provide greatly improved efficiency. The molding 41 illustrated in FIG. 5 features a rectangular flange 43 attached to a return panel 45. The return panel includes two identically-shaped rectangular vertical panels 48, 50 and two identically-shaped rectangular horizontal panels 52, 54. The rectangular panels 48, 50, 52, 54 are attached to respective inner edges of the flange 43 to define a rectangular opening. While the rectangular flange 43 may be separately made and attached to rectangular return panel 45, it is again preferred to form the molding 41 as a unitarily-molded part, for example, made from plastic.

A rectangular groove 55 is cut or otherwise formed in the window frame 49. The rectangular groove 55 lies outside of and spaced apart from the window surface 47. The groove 55 in the window frame 49 is constructed to mate with the rectangular return panel 45 of the molding 43 in male/female fashion. Thus, when drywall is to be installed around the window frame 49, the molding 41 is inserted into the window frame 49. The flange 43 overlaps a drywall panel, e.g., 25, mounted at each side and above and below the window frame 49. Taping and mudding about the rectangular edge 51 of the flange 43 achieves the desired interface between the drywall paneling and the molding. In other embodiments, the flange 43 may be constructed of wood or wood overlay for various upgraded or custom applications. Other shapes and semi-shapes may be configured to accommodate other openings such as semicircular, circular, archways and so forth.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Apparatus for use in drywall installation adjacent a stud comprising:

a flange member means for nailing to said stud;

a panel member means mounted at a right angle to said flange member means for positioning said flange member means to receive the end of a drywall panel;

a window frame located behind the stud; and means for attaching said panel member means to said window frame, said means comprising a tongue means mounted to said window frame and a groove means in said panel means for receiving said tongue means.

2. The apparatus of claim 1 wherein said flange member has a thickness is 1/16-inch or less.

3. The apparatus of claim 1 wherein said panel means has a thickness of a standard drywall sheet.

4. The apparatus of claim 1 wherein said flange member means and panel member means comprise a rectangular panel and rectangular flange unitarily formed together at right angles to one another.

5. The apparatus of claim 1 wherein said flange member means comprises a flange generally following the periphery of a window for overlapping interior wall paneling disposed about said window and wherein said panel member means comprises a panel attached at a right angle to said flange, said panel also generally following the periphery of said window.

6. The apparatus of claim 1 wherein said means comprises a tongue means mounted to said window frame and a groove means in said panel means for receiving said tongue means.

7. Apparatus for use in drywall installation adjacent a stud comprising:

a flange member means for nailing to said stud;

a panel member means integrally formed with said flange member means and mounted at a right angle to said flange member means for positioning said flange member means to receive the end of a drywall panel, said panel member means having a peripheral edge;

a window frame located adjacent said stud; and means comprising a groove located in the window frame for releasably and slidably receiving the peripheral edge of said panel in male-female fashion.

8. The apparatus of claim 7 wherein said flange member means and panel member means comprise a rectangular panel and rectangular flange unitarily formed together at right angles to one another.

9. The apparatus of claim 7 wherein said flange member means comprises a flange generally following the periphery of a window for overlapping interior wall paneling disposed about said window and wherein said panel member means comprises a panel attached at a right angle to said flange, said panel also generally following the periphery of said window.

10. A construction assembly comprising:

a window frame having a groove therein;

a stud located adjacent said window frame having a side face and a front face;

a flange member means;

a drywall panel located between said flange member means and the front face of said stud;

a panel member means located adjacent the side face of said stud for concealing said stud and spaced apart by a gap from said side face so as to avoid the impact of distortions in the stud on said panel member means, said panel member means having a first edge attached to said flange member means and a second edge, said panel member means being dimensioned for positioning said flange member means to receive the end of said drywall panel while at the same time locating said second edge in the groove in said window frame, said second edge residing in said groove in slidable male-female fashion; and fastening means for fastening said flange member means through said drywall panel to said stud.

11. The assembly of claim 10 wherein said gap is an air gap.

12. The assembly of claim 10 wherein said groove is a linear groove, wherein said panel member means is a planar panel and wherein said second edge is of a thickness selected to enter said groove in releasable male-female fashion.

13. The assembly of claim 11 wherein said gap is an air gap.

14. The assembly of claim 12 further comprising a sealant material at least partially filling said air gap.

15. The assembly of claim 13 wherein said sealant material is a flexible sealant material.

16. A construction assembly comprising:

a window frame having a groove therein;

a stud located adjacent said window frame having a side face and a front face;

a flange member means;

a drywall panel located between said flange member means and the front face of said stud;

a panel member means located adjacent the side face of said stud for concealing said stud, said panel member means having a first edge attached to said flange member means and a second edge, said panel member means being dimensioned for positioning said flange member means to receive the end of said drywall panel while at the same time locating said second edge in the groove in said window frame, said second edge residing in said groove in releasable male-female fashion;

gap means between said panel member means and the side face of said stud for protecting said panel member means from adverse impact of distortions in said stud; and fastening means for fastening said flange member means through said drywall panel to said stud.

* * * * *